US011946347B2

(12) United States Patent
Provost

(10) Patent No.: US 11,946,347 B2
(45) Date of Patent: Apr. 2, 2024

(54) CROSS-OVER TOOL, METHOD, AND SYSTEM

(71) Applicant: Wilfred Provost, Tomball, TX (US)

(72) Inventor: Wilfred Provost, Tomball, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/852,518

(22) Filed: Jun. 29, 2022

(65) Prior Publication Data

US 2024/0003228 A1 Jan. 4, 2024

(51) Int. Cl.
*E21B 43/04* (2006.01)
*E21B 34/12* (2006.01)

(52) U.S. Cl.
CPC ..... *E21B 43/045* (2013.01); *E21B 34/12* (2013.01)

(58) Field of Classification Search
CPC ..... E21B 43/04; E21B 43/045
See application file for complete search history.

(56) References Cited

U.S. PATENT DOCUMENTS 187,536 A * 2/1877 Kimball ..... B65G 69/00 406/157
4,474,239 A * 10/1984 Colomb ..... E21B 23/006 166/278
5,145,005 A * 9/1992 Dollison ..... E21B 21/10 251/303
6,481,494 B1 * 11/2002 Dusterhoft ..... E21B 43/267 166/205
6,957,703 B2 * 10/2005 Trott ..... E21B 34/10 251/336
8,191,570 B2 * 6/2012 Purkis ..... E21B 34/12 166/334.1
9,441,454 B2 * 9/2016 Broussard ..... E21B 33/10
2009/0044944 A1 * 2/2009 Murray ..... E21B 43/12 166/308.1
2012/0103606 A1 * 5/2012 van Petegem ..... E21B 33/124 166/278
2016/0281459 A1 * 9/2016 Stautzenberger ..... E21B 33/04
2021/0156226 A1 * 5/2021 Galindo ..... E21B 34/12
2022/0081994 A1 * 3/2022 Chevallier ..... E21B 34/063

* cited by examiner

*Primary Examiner* — Tara Schimpf
*Assistant Examiner* — Yanick A Akaragwe
(74) *Attorney, Agent, or Firm* — CANTOR COLBURN LLP

(57) ABSTRACT

A cross-over tool including a housing having an extension port therein, a gravel pack port sleeve having a gravel pack port structure and a seal disposed at a radially inward surface of the port structure, and an activation sleeve having an opening therein, the activation sleeve being in dynamic sealing contact with the seal of the port structure. A borehole system including a borehole in a subsurface formation, a completion string in the borehole, and a tool disposed in the completion string. A method for gravel packing a borehole including releasing the housing from a latch connected to a workstring, applying tension to the activation sleeve with the workstring, and aligning the opening of the activation sleeve with the gravel pack port.

12 Claims, 3 Drawing Sheets

CROSS-OVER TOOL, METHOD, AND SYSTEM

BACKGROUND

In the resource recovery industry and fluid sequestration industry gravel packing may be undertaken to support borehole walls or filter fluids for example. Gravel pack operations often include cross over tools. Such tools have been known to the industry for quite some time and generally employ a plug conveyed through the workstring to facilitate particular operations of the system. While dropping a plug, such as a ball, is effective in many situations, it can cause undue delay due to time it takes the plug to traverse the borehole and/or be pushed along with fluid flow for highly deviated or horizontal boreholes. Time is directly correlated to cost in the subject industries and hence the art would well receive alternatives that reduce time required.

SUMMARY

An embodiment of a cross-over tool including a housing having an extension port therein, a gravel pack port sleeve having a gravel pack port structure and a seal disposed at a radially inward surface of the port structure, and an activation sleeve having an opening therein, the activation sleeve being in dynamic sealing contact with the seal of the port structure.

An embodiment of a borehole system including a borehole in a subsurface formation, a completion string in the borehole, and a tool disposed in the completion string.

An embodiment of a method for gravel packing a borehole including releasing the housing from a latch connected to a workstring, applying tension to the activation sleeve with the workstring, and aligning the opening of the activation sleeve with the gravel pack port.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
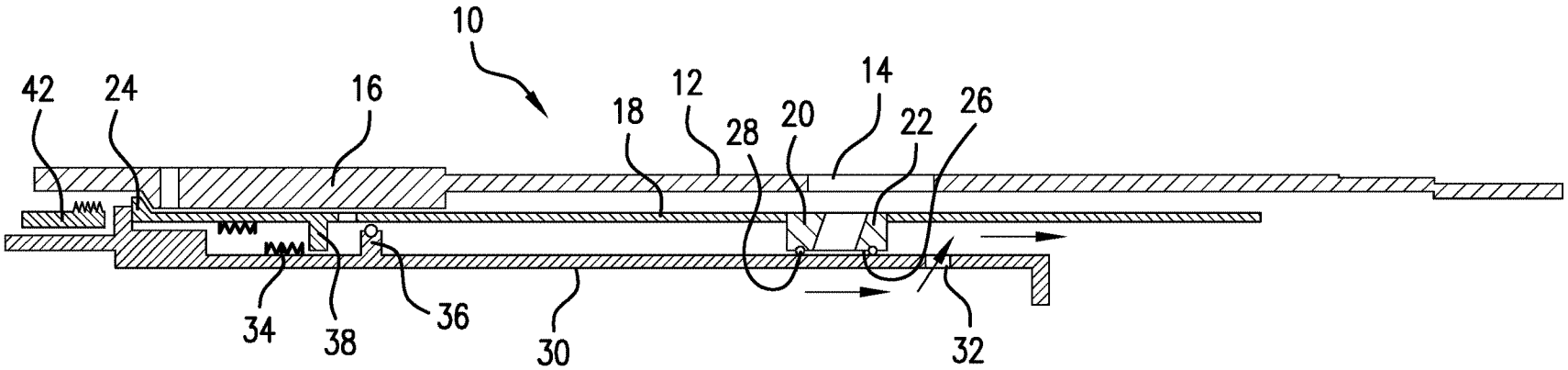
FIG. 1 is a schematic section view of a cross over tool as disclosed herein.

Referring to FIG. 1, a cross-over tool 10 is illustrated in schematic cross section. Tool 10 includes a housing 12 having an extension port 14 therein. Disposed upon the housing 12 is a seal element 16 such as a packer. The packer may be mechanical, swellable or inflatable and may be set in accordance with normal procedure.

Disposed within the housing 12 is a gravel pack port sleeve 18 having a gravel pack port structure 20 as a part thereof, the port structure 20 defining a port 22 therethrough.

The port sleeve 18 is slidably disposed in the housing 12 and includes a no go shoulder 24 to prevent the port sleeve 18 moving relative to the housing in one direction beyond seating of the shoulder 24 against housing 12. The port sleeve 18 is movable in the opposite direction to allow for positioning and for pulling out of the hole. At a radially inward surface 26 of the structure 20 are seals 28 that are disposed on either longitudinal end of the port 22 and function to dynamically seal the structure 20 to a radially inwardly positioned activation sleeve 30. The sleeve 30 includes an opening 32 therein that allows initially for Inside Diameter (ID) flow through the sleeve 30 for washdown and flow during running. The sleeve 30 further includes a lock 34 that is interactive with the port sleeve 18 to, once engaged, prevent any further relative motion between the port sleeve 18 and the activation sleeve 30. This lock in an embodiment is a body lock ring although it is contemplated that this lock may also be a C-ring, a collet, any other type of snap ring, etc. Also, in an embodiment, a stop 36 and a counter stop 38 are disposed upon sleeve 30 and sleeve 18 such that they will contact one another at a certain position of the sleeve 30 relative to sleeve 18 and prevent further relative movement in the same direction. The stop and counter stop are illustrated in contact in FIG. 2.

Figure 2:
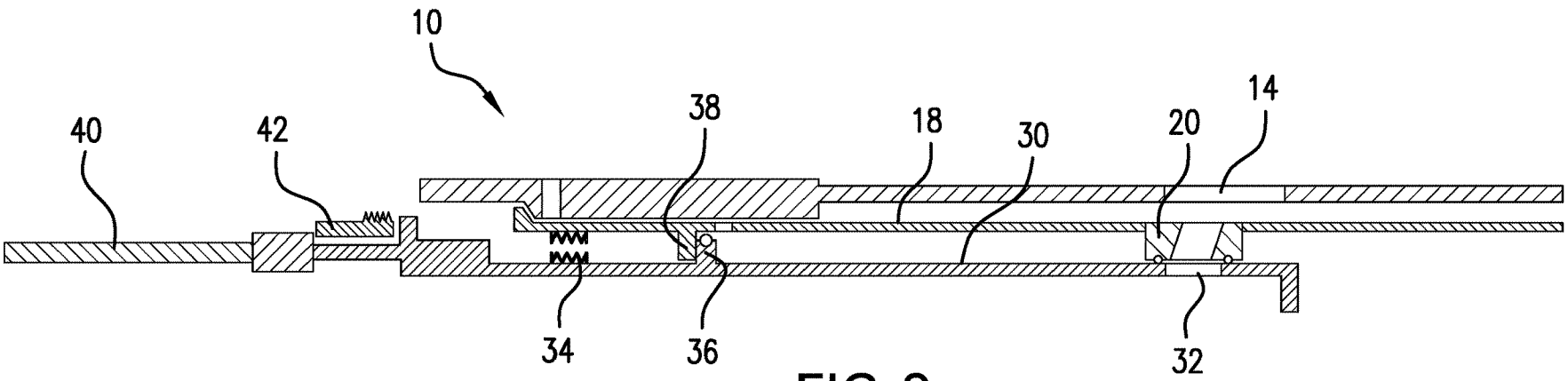
FIG. 2 is the tool as illustrated in FIG. 1 in a second operational position.

Referring to FIG. 2, the tool 10 is illustrated in a second operational position where the opening 32 is aligned with the port 22. Viewing this portion of FIG. 2 against the position in FIG. 1 will make clear the flow path prior to moving the sleeve 30 versus after moving sleeve 30. Initially the opening 32 allows flow for washdown and then after movement of sleeve 30 the opening 32 is aligned with port 22 so that gravel slurry may be ported to an outside diameter of the housing 12 to create a gravel pack. The stop and counter stop 36 and 38 are shown in contact with one another in FIG. 2 and it should be understood that with the sleeve 30 moved to the position in FIG. 2, the lock 34 is engaged and the opening 32 will stay aligned with the port 22 permanently. It is to be appreciated that moving the tool 10 to a gravel packing position requires simply application of tension to a workstring 40 upon which the tool 10 is supported. There is no need to drop a plug of any kind. There is no wait time and no chance for a plug getting hung on its way to a seat that the tool 10 does not possess. Accordingly, the tool as disclosed improves reliability and reduces time required for a gravel packing operation.

Figure 3:
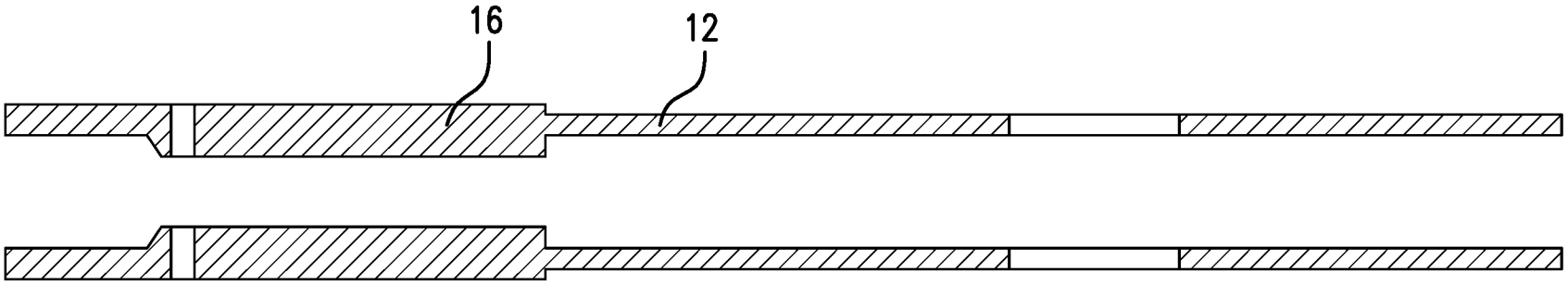
FIG. 3 is the housing and packer of the tool illustrated in FIG. 1 having been left in the borehole after pulling other components of the tool

In use, the tool 10 is made up to the workstring 40 and latched with a latch 42. The position of the latch 42 when latched is illustrated in FIG. 1 while the position of the latch 42 unlatched is illustrated in FIG. 2. In any case, after the latch is unlatched from the housing 12, the workstring may be pulled uphole to reposition the sleeve 30 and with it the opening 32. The opening 32 will, as mentioned above, align with the port 22 when the stop and counterstop 36/38 contact one another as shown in FIG. 2. Flow from surface (gravel slurry, frac slurry, etc.) is then flowed out the extension port. Once all packing operation is complete, a portion of the tool 10 is retrieved to surface. That is the sleeve 18 and the sleeve 30 with all parts of each one. Removal of these sleeves to surface will leave the tool 10 in the condition shown in FIG. 3 wherein the housing and its seal are left in the hole as a portion of the completion and with a gravel pack radially outwardly thereof. The tool then has a full drift diameter therewithin for future borehole operations.

Figure 4:
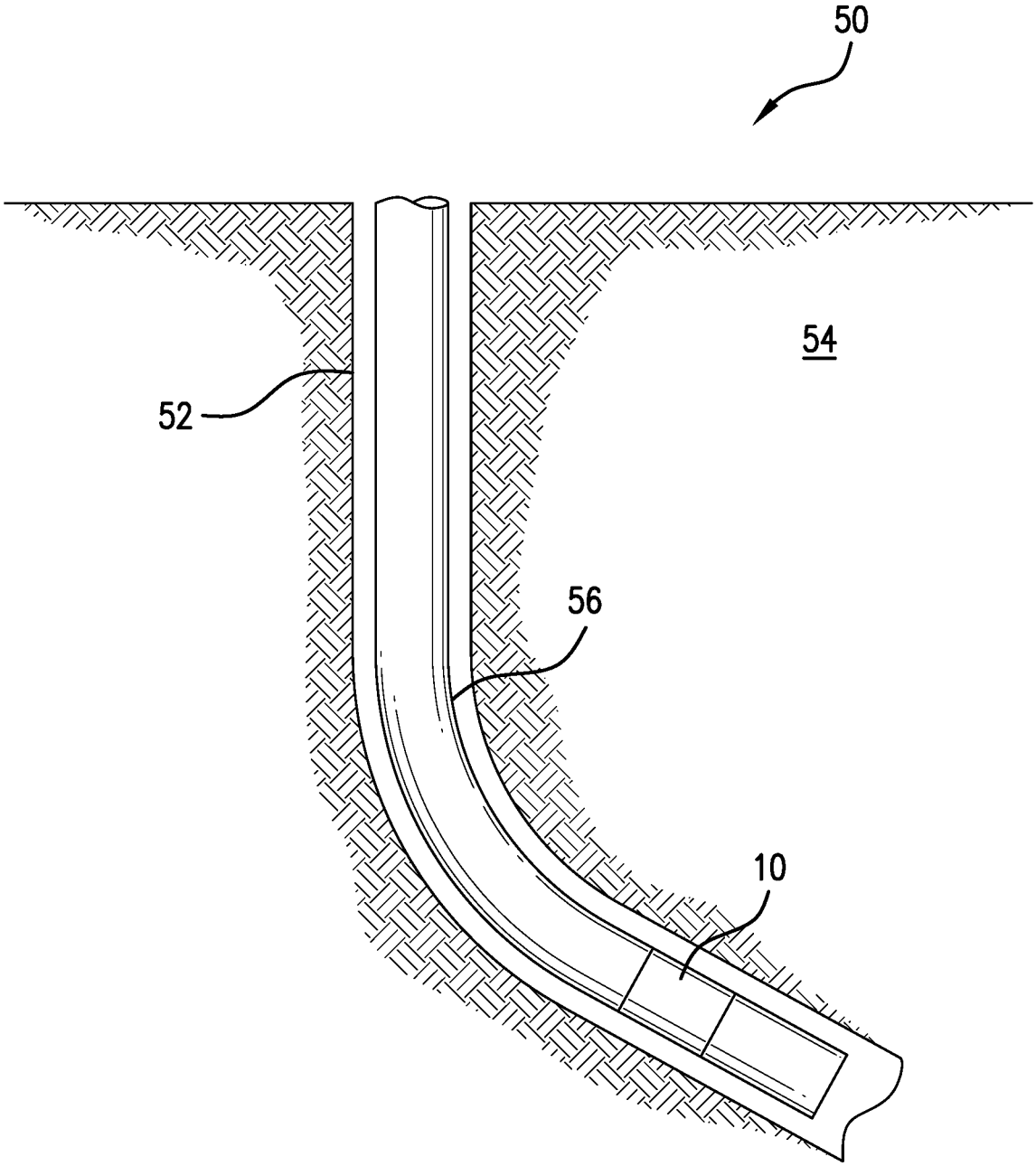
FIG. 4 is a view of a borehole system including cross over tool as disclosed herein.

Referring to FIG. 4, a borehole system. The borehole system 50 comprises a borehole 52 in a subsurface formation 54. A string 56 is disposed within the borehole 52, and the cross-over tool 10 is disposed within or as a part of the string 56 disclosed herein.

Set forth below are some embodiments of the foregoing disclosure:

Embodiment 1: A cross-over tool including a housing having an extension port therein, a gravel pack port sleeve having a gravel pack port structure and a seal disposed at a radially inward surface of the port structure, and an activation sleeve having an opening therein, the activation sleeve being in dynamic sealing contact with the seal of the port structure.

Embodiment 2: The tool as in any prior embodiment further including a lock that when engaged prevents relative motion between the port sleeve and the activation sleeve.

Embodiment 3: The tool as in any prior embodiment wherein the lock is a body lock ring.

Embodiment 4: The tool as in any prior embodiment further including a stop limiting relative movement between the activation sleeve and the port sleeve.

Embodiment 5: The tool as in any prior embodiment wherein the shoulder when shouldered positions the activation sleeve relative to the port sleeve such that the opening of the activation sleeve is aligned with the gravel pack port of the port sleeve.

Embodiment 6: The tool as in any prior embodiment further including a sealing element disposed on the housing.

Embodiment 7: A borehole system including a borehole in a subsurface formation, a completion string in the borehole, and a tool as in any prior embodiment disposed in the completion string.

Embodiment 8: A method for gravel packing a borehole including releasing the housing as in any prior embodiment from a latch connected to a workstring, applying tension to the activation sleeve with the workstring, and aligning the opening of the activation sleeve with the gravel pack port.

Embodiment 9: The method as in any prior embodiment further including engaging a lock, which thereafter prevents relative movement between the activation sleeve and the gravel pack port sleeve.

Embodiment 10: The method as in any prior embodiment further including pumping a fluid through the workstring and through the opening, gravel pack port and extension port.

Embodiment 11: The method as in any prior embodiment further including setting a seal element about the housing.

Embodiment 12: The method as in any prior embodiment further including pulling the gravel pack port sleeve and the activation sleeve out of the borehole leaving the element and housing in the borehole.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A cross-over tool comprising:

a housing having an extension port therein;

a gravel pack port sleeve having a gravel pack port structure and a seal disposed at a radially inward surface of the port structure; and an activation sleeve having an opening therein, the activation sleeve being in dynamic sealing contact with the seal of the port structure, the activation sleeve movable by application of tension thereon to align the opening of the activation sleeve with the gravel pack port structure and close a washdown flow path by the application of tension.

2. The tool as claimed in claim 1 further including a lock that when engaged prevents relative motion between the port sleeve and the activation sleeve.

3. The tool as claimed in claim 2 wherein the lock is a body lock ring.

4. The tool as claimed in claim 1 further including a stop limiting relative movement between the activation sleeve and the port sleeve.

5. The tool as claimed in claim 4 wherein the activation sleeve when shouldered, positions the activation sleeve relative to the port sleeve such that the opening of the activation sleeve is aligned with the gravel pack port structure of the port sleeve.

6. The tool as claimed in claim 1 further including a sealing element disposed on the housing.

7. A borehole system comprising:

a borehole in a subsurface formation;

a completion string in the borehole; and a tool as claimed in claim 1 disposed in the completion string.

8. A method for gravel packing a borehole comprising:

releasing a housing from a latch connected to a workstring, the housing being a part of a cross over tool, the tool comprising the housing, the housing an extension port therein;

a gravel pack port sleeve having a gravel pack port structure and a seal disposed at a radially inward surface of the port structure; and an activation sleeve having an opening therein, the activation sleeve being in dynamic sealing contact with the seal of the port structures;

applying tension to the activation sleeve with the workstring; and aligning the opening of the activation sleeve with the gravel pack port structure.

9. The method as claimed in claim 8 further including engaging a lock, which thereafter prevents relative movement between the activation sleeve and the gravel pack port sleeve.

10. The method as claimed in claim 8 further including pumping a fluid through the workstring and through the opening, gravel pack port structure and extension port.

11. The method as claimed in claim 8 further including setting a seal element about the housing.

12. The method as claimed in claim 11 further including pulling the gravel pack port sleeve and the activation sleeve out of the borehole leaving the seal element and housing in the borehole.

* * * * *